US006314839B1

(12) United States Patent
Carter

(10) Patent No.: US 6,314,839 B1
(45) Date of Patent: Nov. 13, 2001

(54) REVERSIBLE RACHET WRENCH

(76) Inventor: James M. Carter, P.O. Box 3478, Las Cruces, NM (US) 88003

( * ) Notice: Subject to any disclaimer, the term of this patent is extended or adjusted under 35 U.S.C. 154(b) by 0 days.

(21) Appl. No.: 09/723,381

(22) Filed: Nov. 27, 2000

(51) Int. Cl.[7] ..... B25B 13/46

(52) U.S. Cl. ..... 81/63

(58) Field of Search ..... 81/60–63.2

(56) References Cited

U.S. PATENT DOCUMENTS

| | | | | |
|---|---|---|---|---|
| 4,254,675 | * | 3/1981 | Marlow et al. | 81/63 |
| 4,274,311 | * | 6/1981 | Ebert | 81/63 |
| 4,967,624 | * | 11/1990 | Farris | 81/63 |
| 5,761,972 | * | 6/1998 | Sanders | 81/60 |
| 5,957,008 | * | 9/1999 | Long | 81/63 |

* cited by examiner

*Primary Examiner*—D. S. Meislin
(74) *Attorney, Agent, or Firm*—DeWitt M. Morgan

(57) ABSTRACT

The reversible rachet wrench which includes: a support body having a head portion and a handle support portion having a cylindrically shaped section; a rachet wheel having teeth extending around the perimeter thereof; a pawl member; a pivot member; and a rotatable handle. The pawl member, which is pivotally supported by the head portion, includes a pair of spaced apart teeth engaging members, which are alternatively engagable with the teeth on the rachet wheel. The pivot member, pivotally supported on the support body, includes first and second ends and an intermediate pivot point. The first end includes a means for engaging the coupling means provided on the pawl member. The second end includes a means for engagement with the rotatable handle. The handle, which is rotatably supported on the cylindrically shaped section, includes a first end having recess for receiving the second end of said pivot member, whereby rotation of the handle about the cylindrically shaped section moves the pivot member about the pivot point, thereby moving the pawl member from a first position to a second position. The handle rotates relative to the cylindrically shaped section through an angle of, preferably, 40°–60°. The first end of the handle may also include a second, longer recess for receiving the second end of the pivot member. The handle support portion is solid and integral with the head portion. Finally, the wrench includes a spring biased detent which is biased into engagement with either one or the other of two surfaces provided on the pawl member.

11 Claims, 2 Drawing Sheets

REVERSIBLE RACHET WRENCH

FIELD OF THE INVENTION

This invention relates to reversible rachet wrenches. More particularly, this invention relates to a reversible rachet wrench which is rugged, has a reversing mechanism comprising only three moving parts, and costs less to produce than other, more complicated designs.

BACKGROUND OF THE INVENTION

Reversible rachet wrenches are well known. While there are numerous different designs, a typical reversible rachet wrench includes a head portion and a handle portion. Mounted in the head portion is a toothed rachet wheel and a socket pin. The head also includes a pivotal pawl element or member and a mechanism to pivot the pawl element from a first position (where the rachet wheel rotates in a clockwise direction) to a second position (where the rachet wheel rotates in a counterclockwise direction).

The mechanisms for effecting reversal of the direction of the rachet wheel are quite varied. Perhaps the most common mechanism is illustrated in FIGS. 1 and 2 of U.S. Pat. No. 5,761,972 to J. A. Sanders. The direction reversal mechanism includes a two position pawl 27 which engages rachet wheel 18 (referred to as a spur gear) for rotating of the socket pin 16 in either a clockwise or counterclockwise direction. The pawl assembly includes a pawl lever 24 connected, via shaft 26, to the pawl 27 for switching, as desired by the user, between engagement for clockwise or counterclockwise rotation of the rachet wheel and socket pin. Sanders also includes an advancing lever 30, extending from a slot in the side of handle 14 for "finger" tightening or loosening.

U.S. Pat. No. 4,254,675 to Marlow et al., discloses a reversible rachet wench which includes a head portion, a handle portion 14, a toothed rachet wheel 24 and a pawl element 34. Reversal of the direction of pawl 34 is effected by a mechanism that includes a control rod 52 having an enlarged end 54 with an offset bore 58 (in which is received spring 60 and pawl engaging pin 62). The opposite end of rod 52 is connected to barrel 70 via cap 78. When it is desired to reverse the rotational direction of rachet wheel 24, the operator merely pushes barrel 70 toward the head until a detent enters notch 64, and then rotates barrel 70 in either a clockwise or counterclockwise direction. As barrel 70 rotates so does control rod 52 and pin 62. Since the pin is eccentrically mounted, it rides up or down the engaged cam surface (98 or 100) of pawl element 34 until it reaches junction 102. Continued rotation of barrel 70 moves the pin past the junction and as it does spring 60 releases its energy and forces pin 62 outwardly against the newly engaged cam surface and forces the pawl element 34 to rotate quickly to engage the other pawl member 84, 86 with the wheel 24, thereby permitting rotation of the rachet wheel in the direction opposite of the initial direction and preventing rotation in the initial direction.

Other direction reversing mechanisms are illustrated in U.S. Pat. No. 4,869,138 (J. L. Ferris), U.S. Pat. No. 4,967,624 (J. L. Ferris), U.S. Pat. No. 4,274,311 (E. Ebert), U.S. Pat. No. 3,659,484 (G. L. Scodeller), U.S. Pat. No. 4,457,107 (S. Waiser), U.S. Pat. No. 5,582,080 (T. C. Barmore), U.S. Pat. No. 5,957,008 (P. S. Long), and U.S. Pat. No. 4,631,990 (M. E. Hughes). All the foregoing suffer from the drawback that they include numerous parts, all of which increases manufacturing costs and reduces reliability.

OBJECTS OF THE INVENTION

It is the object of the present invention to provide for a reversible rachet wrench which is simple in design, has few moving parts, is cheap and easy to manufacture, rugged, and convenient for the operator to reverse the directional rotation of the rachet in tight working conditions.

These, and other objects will be obvious from the following description.

SUMMARY OF THE INVENTION

The reversible rachet wrench of the present invention includes: a support body having a head portion and a handle support portion having a cylindrically shaped section; a rachet wheel having teeth extending around the perimeter thereof, rotatably supported by the head portion; a pawl member; a pivot member; and a rotatable handle. The pawl member, which is pivotally supported by the head portion, includes a pair of spaced apart teeth engaging members, which are alternatively engagable with the teeth on the rachet wheel. The pivot member, pivotally supported on the support body, includes first and second ends and an intermediate pivot point. The first end includes a means for engaging the coupling means provided on the pawl member. The second end includes a means for engagement with the rachet handle. The handle, which is rotatably supported on the cylindrically shaped section, includes a first end having a recess for receiving the second end of said pivot member, whereby rotation of the handle about the cylindrically shaped section moves the pivot member about the pivot point, thereby moving the pawl member from a first position to a second position. The handle rotates relative to the cylindrically shaped section through an angle of less than 360°, preferably 40°–60°. Optionally, the first end of the handle includes a second, longer recess for receiving the second end of the pivot member. The handle support portion is solid and integral with the head portion. Finally, the wrench includes a spring biased detent which is biased into engagement with either one or the other of two surfaces provided on the pawl member.

DESCRIPTION OF THE PREFERRED EMBODIMENT

Figure 1:
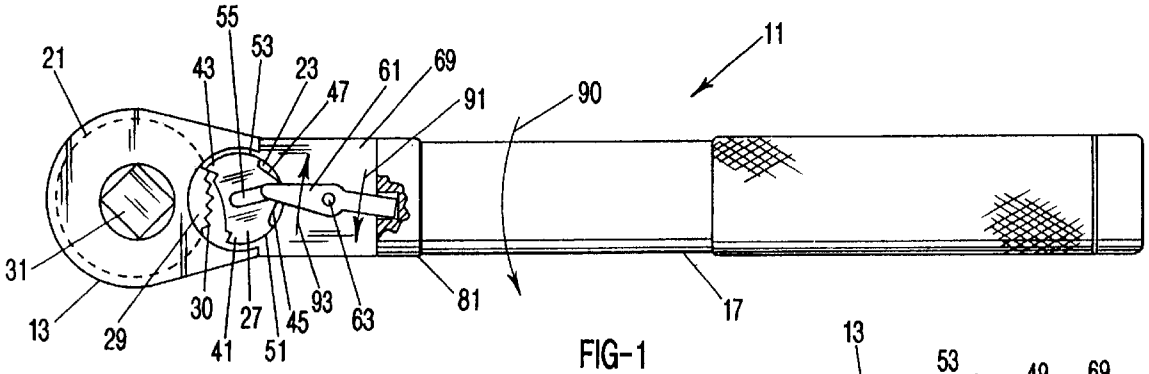
FIG. 1 is a top view of the rachet wrench of the present invention with the cover for the pawl reversal mechanism removed and a portion of the handle broken away.

Rachet wrench 11 includes a head portion 13, a handle support portion 15 and a handle 17. Head portion 13 and handle support portion 15 are integral. Head portion 13 includes a pair of overlapping cylindrical cavities 21 and 23 in which are supported, respectively, rachet wheel assembly 25 and pawl 27.

Figure 3:
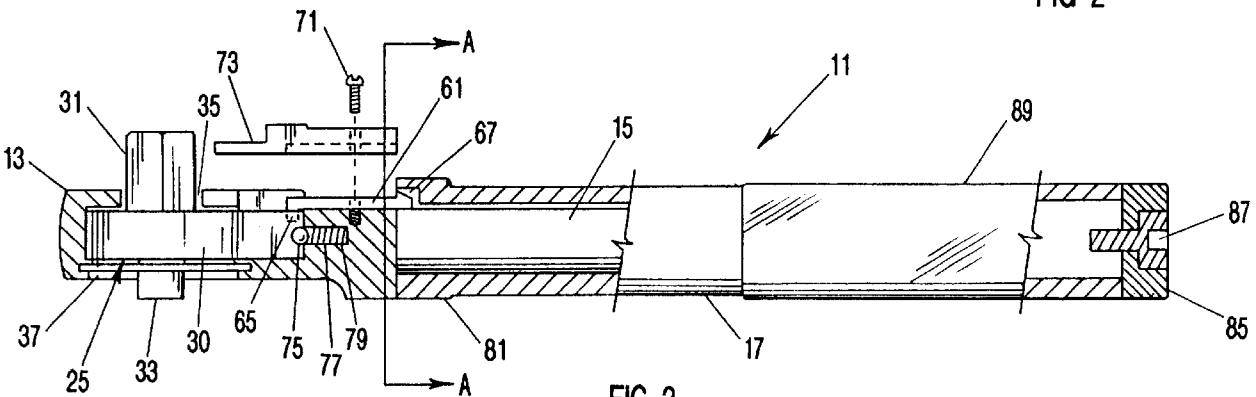
FIG. 3 is a side view, partially exploded and partially sectional, of the rachet wrench of the present invention.
Figure 4:
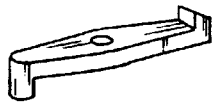
FIG. 4 is a perspective view of the pivot member of present invention.
Figure 5:
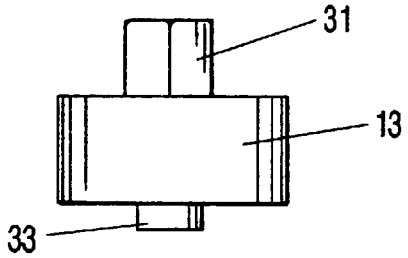
FIG. 5 is the head end view of the rachet wrench of the present invention.

Rachet wheel assembly 25, which is of conventional design, includes rachet wheel 29 having teeth 30, and a socket pin 31. Socket pin 31 includes a conventional spring loaded ball detent (not shown), which is necessary for holding a socket wrench (also not shown), and a button 33 for releasing the detent and, hence, the socket wrench. As this mechanism is well known, it has not been illustrated. As best illustrated in FIG. 3, cavity 21 has an opening 35 through which socket pin 31 passes. The opposite side of cavity 15 is closed off by a disc shaped cover 37.

Figure 2:
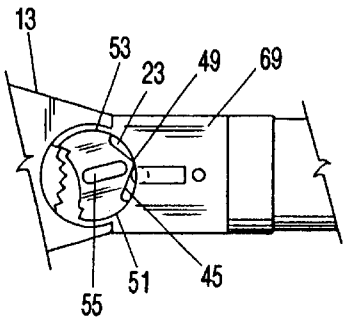
FIG. 2 is partial top view with the pivot member removed.

As best illustrated in FIGS. 1 and 2, pawl 27 includes a pair of spaced apart pawl teeth 41, 43, a pair of detent receiving recesses 45, 47 separated by a junction 49. Pawl 27 also includes a pair of arcuate surfaces 51, 53 which have substantially the same radius of curvature as cylindrical cavity 23, whereby pawl 27 rotates within cavity 23. Finally, pawl 27 includes an elongated slot 55.

Supported in the area between head portion 13 and handle support 15 is pivot 61, which includes a pivot point defined by opening 63, a first end having a driver pin 65, (which is received in slot 55), and a second end including a raised lobe 67. Pivot 61 is secured to flat surface 69 via screw 71, which also secures cover plate 73 in place. Plate 73 includes a recessed area, not shown, in which pivot 61 is received. Also supported between head portion 13 and handle support 15 is detent ball 75 and spring 77 (which is received in recess 79). Spring 77 biases ball 75 into one or the other of recesses 45, 47.

Figure 6:
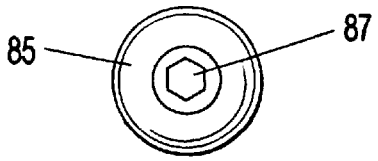
FIG. 6 is the handle end view of the rachet wrench of the present invention.

Handle support portion 15 is cylindrical in cross section to rotatably support handle 17. Handle 17 includes a first end 81 which, as best illustrated in FIGS. 3 and 6, includes an elongated (in the direction of rotation of handle 17) arcuate recess 83 in which is received lobe 67. Handle 17 is held in place by a cap 85 which is secured to handle support 15 via screw 87 as illustrated in FIG. 3. Back end portion 89 is, optionally knurled.

In operation, rotation of handle 17 in the counterclockwise direction, as indicated by arrow 90, pivots pivot 61 in the clockwise direction, as indicated by arrows 91 and 93, to rotate pawl 27 in a counterclockwise direction to the position illustrated in FIG. 1. Pawl 27 is held in this position by ball 75, which is biased into engagement against recess 45 by spring 77. To reverse the direction of rachet wheel 29, handle 17 is rotated in the counterclockwise direction. This also rotates recess 83 in the same direction which, in turn, moves lobe 67 also in the same direction to pivot pivot 61 in the counterclockwise direction. Because of the coupling between slot 55 and pin 65, pawl is rotated in the clockwise direction. This movement forces ball 75 inward, then past junction 49, at which point spring 77 pushes it outward and into recess 47.

Figure 7:
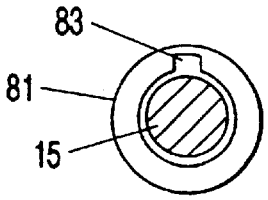
FIG. 7 is the front end view of the handle portion of the rachet wrench taken along line A—A, with the pivot removed.
Figure 8:
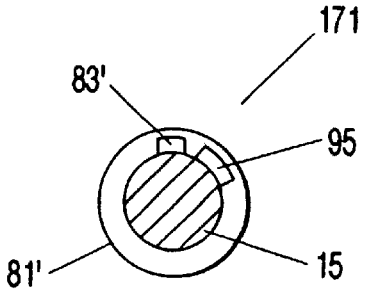
FIG. 8 is the front end view of the alternate handle of the present invention.

The amount of rotation required to switch the direction of pawl 27 is relatively small, in the order of 40°–50°. It can be increased or decreased by changing the arcuate length (in the direction of rotation of handle 17) of recess 83. An alternate handle $17^1$ is illustrated in FIG. 7, which includes arcuate recess 83 and longer arcuate recess 95, which would permit a larger rotation of handle $17^1$ relative to handle support 15 to effect rotation of pawl 27. The operator can change from one recess to the other by removing end cap 85 sliding handle $17^1$ to the right (as viewed in FIG. 3) to disengage lobe 67 from, for instance, recess 83, rotating handle 17 to align recess 93 with lobe 67, moving handle $17^1$ back to the left, and reattaching end cap 85.

Whereas the drawings and accompanying description have shown and described the preferred embodiment of the present invention, it should be apparent to those skilled in the art that various changes may be made in the form of the invention without affecting the scope thereof.

I claim:

1. A reversible rachet wrench comprising:

(a) a support body including a head portion and a handle support portion, said handle support portion including a cylindrically shaped section;

(b) a rachet wheel rotatably supported by said head portion, said rachet wheel including teeth extending around the perimeter thereof;

(c) a pawl member pivotally supported by said head portion, said pawl member including a pair of spaced apart teeth engaging means alternatively engagable with said teeth on said rachet wheel, said pawl further including a coupling means;

(d) a pivot member pivotally supported by said support body, said pivot member including first and second ends and an intermediate pivot point, said first end including a means for engaging said coupling means; and (e) a handle rotatably supported on said cylindrically shaped section, said handle having first and second ends, said first end including a means for receiving said second end of said pivot member, whereby rotation of said handle about said cylindrically shaped section moves said pivot member about said pivot point, thereby moving said means for engagement to pivot said pawl member from a first position to a second position.

2. The wrench of claim 1, wherein said handle rotates relative to said cylindrically shaped section through an angle of less than 360 degrees.

3. The wrench of claim 2, wherein said handle rotates through as angle of less than 60° degrees.

4. The wrench of claim 1, wherein said first end of said handle includes a second means for receiving said second end of said pivot member.

5. The wrench of claim 4, wherein said means for receiving is a slot and said second means for receiving is a second slot, and wherein said second slot is longer than said slot.

6. The wrench of claim 1, whereon said handle support portion is solid.

7. The wrench of claim 1, wherein said head portion and said handle support portion are integral.

8. The wrench of claim 7, wherein said handle support portion is solid.

9. The wrench of claim 1, wherein said pawl member includes first and second spaced apart surfaces, and further including a spring biased detent support by said support body and biased into engagement with either one or the other of said first and second pawl surfaces.

10. The wrench of claim 1, wherein said coupling means is a slot and said means for engaging is a pin received in said slot.

11. A reversible rachet wrench comprising:

(a) a support body including a head portion and a handle portion;

(b) a rachet wheel rotatably supported by said head portion, said rachet wheel including teeth extending around the perimeter thereof;

(c) a pawl member pivotally supported by said head portion, said pawl member including a pair of spaced apart teeth engaging means alternatively engagable with said teeth on said rachet wheel, said pawl further including a coupling means;

(d) a pivot member pivotally supported by said support body, said pivot member including first and second ends and an intermediate pivot point, said first end including a means for engaging said coupling means; and (e) said handle portion including a cylindrically shaped section and a sleeve rotatably supported thereon, said sleeve having first and second ends, said first end including a means for receiving said second end of said pivot member, whereby rotation of said sleeve about said cylindrically shaped section moves said pivot member about said pivot point, thereby moving said means for engagement to pivot said pawl member from a first position to a second position.

* * * * *